US005337643A

United States Patent [19]

Cantrell

[11] Patent Number: 5,337,643

[45] Date of Patent: Aug. 16, 1994

[54] GUITAR NECK APPARATUS

[76] Inventor: Charles E. Cantrell, P.O. Box 174, Salem, S.C. 29676

[21] Appl. No.: 82,386

[22] Filed: Jun. 28, 1993

[51] Int. Cl.[5] ..... G10D 3/00

[52] U.S. Cl. ..... 84/293

[58] Field of Search ..... 84/267, 293, 328

[56] References Cited

U.S. PATENT DOCUMENTS

| | | | |
|---|---|---|---|
| 3,392,618 | 7/1968 | Pelensky | 84/267 |
| 4,192,213 | 3/1980 | Steinberger | 84/293 |
| 4,681,009 | 7/1987 | Mouradian | 84/293 |
| 4,759,250 | 7/1988 | Lieber | 84/293 |
| 5,239,908 | 8/1993 | Attias | 84/293 X |

*Primary Examiner*—Michael L. Gellner
*Assistant Examiner*—Patrick J. Stanzione

[57] ABSTRACT

A new and improved guitar neck apparatus is provided that includes a plurality of convexly curved fret portions and a convexly curved first guitar neck portion underlying and supporting the convexly curved fret portions. The convexly curved first guitar neck portion extends between the guitar body portion and the string-tension-adjusting portion. The convexly curved first guitar neck portion includes a concavely shaped underside portion. A tongue portion extends radially from the concavely shaped underside portion. The tongue portion divides the concavely shaped underside portion into two symmetrical concavely shaped groove portions suitable for receipt of one or more fingers of a guitar player. A reinforcement member is located in the tongue portion of the apparatus and extends from the guitar body portion to the string-tension-adjusting portion. An adjustable balancing assembly is provided that fits onto the guitar neck apparatus. The adjustable balancing assembly may include a resilient housing member that permits the adjustable balancing assembly to be installed on edge portions and of the convexly curved first guitar neck portion by a snap action. Alternatively, the adjustable balancing assembly may include a resilient housing member that permits the adjustable balancing assembly to be installed on the tongue portion of the guitar neck apparatus by a snap action. A plurality of slide-assist assemblies may be installed in the housing member to facilitate sliding of the adjustable balancing assembly along the guitar neck apparatus.

13 Claims, 4 Drawing Sheets

GUITAR NECK APPARATUS

BACKGROUND OF THE INVENTION

1. Field of the Invention

The present invention relates generally to guitars, and more particularly, to a guitar neck assembly.

2. Description of the Prior Art

Guitars are musical instruments that have been popular for many years. Over the years, many innovations in guitar technology have taken place. Some of these innovations have been particularly related to the guitar neck. For example, the following U.S. Pat. Nos. disclose some such innovations in guitar neck technology that have been developed over the years: 3,943,816; 4,528,886; 4,982,640; 5,072,643; and Des. 297,332. More specifically, U.S. Pat. No. 3,943,816 relates to the material composition composing a guitar neck. U.S. Pat. No. 4,528,886 relates to a method of making guitar necks. U.S. Pat. No. 4,982,640 relates to a releasable neck joint for a guitar. U.S. Pat. No. 5,072,643 relates to a method for making a fret structure in a guitar. U.S. Pat. No. Des. 297,332 relates to a guitar neck having a portion offset from the guitar body.

Although innovations in guitar neck technology have been directed to the problems solved in the patents mentioned above, there are additional problems in guitar playing that have not been addressed by the prior art cited above. Generally, guitar necks have a cross-sectional profile that resembles a semi-circle. That flat portion of the semi-circle is located topmost and is where the frets are located and is where the fingering of the guitarist takes place. The round portion of the semi-circle lies underneath the topmost flat portion. The palm of the guitarist's hand and the guitarist's thumb are located adjacent to the bottom, semi-circular round portion of the neck when the guitarist is playing.

A number of problems are associated with the conventional semi-circular guitar neck. For one thing, the topmost flat board has a relatively small surface area. In this respect, a guitarist's fingers are often quite crowded when positioned on the topmost flat portion. In this respect, it would be desirable if a guitar neck device were provided that alleviated crowding of the guitarist's fingers on the topmost fret board of the guitar neck.

With conventional semi-circular guitar necks, the guitarist's fingers are often quite cramped as they are curled to be placed on the flat, topmost fret board of the semi-circular guitar neck. In this respect, it would be desirable if a guitar neck device were provided that relieved the cramping of the guitarist's fingers to be placed on the topmost, flat fret board of a semi-circular guitar neck.

With conventional semi-circular guitar necks, the guitarist's thumb very often sticks out from the guitarist's hand without having a suitable place to rest. Such positioning of the thumb is a factor that can contribute to fatigue of the guitarist. In this respect, it would be desirable if a guitar neck device were provided that had provisions for resting the resting the thumb so as to lessen fatigue of the guitarist.

With the conventional semi-circular guitar neck, as mentioned above, the topmost flat portion has a relatively small surface area. Another consequence of the relatively small surface area of the topmost flat portion of the semi-circular guitar neck is the crowding of the guitar strings. With the crowding of the strings, accuracy and precision in fingering is sometimes quite difficult. In this respect, it would be desirable if a guitar neck device were provided that had less string crowding and thus facilitated a more accurate and precise string fingering by the guitarist.

As discussed above, the conventional semi-circular guitar neck often results in undesirable finger cramping leading to premature fatigue and inaccurate and imprecise fingering. Another undesirable result may take place as a result of the finger crowding. When a player feels the crowding, the player may also experience a negative psychological impact. The player may feel that the guitarist's style itself is cramped. This may lead to a failure in the guitarist to fully and freely express the artistic impulses. In this respect, it would be desirable if a guitar neck device were provided that imparted to the guitarist a greater feeling of style freedom by reducing finger cramping.

Another potential negative effect or finger crowding is that the guitarist may not feel relaxed in playing. Such a feeling may be another inhibiting factor in the guitarist playing with a full and relaxed style. In this respect, it would be desirable if a guitar neck device were provided that facilitated to the guitarist relaxed feeling while playing by reducing finger cramping on the guitar neck.

In playing a guitar proper balance of the guitar on the guitarist is often an important factor in the playing of the instrument. Guitar balance has several distinct aspects. First, there is the location of the center of gravity of the guitar itself. Second, there is the location of a balance point when the guitarist holds the guitar in one or another positions. Individual guitarists have individual methods for holding and positioning the guitar. In this respect, achieving desired balance for a specific guitar for different guitarists may be a difficult task. In this respect, it would be desirable if a guitar neck device were provided that facilitated a guitarist achieving desired balance of the guitar for the guitarist's specific style of playing.

Since different players use different positions for holding the guitar, it would be desirable if means were provided for adjusting guitar balance that were readily adjustable on the guitar.

With a guitar neck in particular, as with a guitar in general, there is a tradeoff between design shape and strength. Often, materials employed to make complex shapes lack a certain degree of structural strength. In this respect, reinforcement with structural strong components may be desired. In this respect, it would be desirable if a guitar neck device were provided that included a structural reinforcement component for adding structural strength to the guitar neck.

Thus, while the foregoing body of prior art indicates it to be well known to have innovations in guitar necks, the prior art described above does not teach or suggest a guitar neck apparatus which has the following combination of desirable features: (1) alleviates crowding of the guitarist's fingers on the topmost portion of the guitar neck; (2) relieves the cramping of the guitarist's fingers to be placed on the topmost, flat portion of a semi-circular guitar neck; (3) has provisions for resting the thumb so as to lessen fatigue of the guitarist's hand; (4) has less string crowding and thus facilitates a more accurate and precise string fingering by the guitarist; (5) imparts to the guitarist a greater feeling of style freedom by reducing finger cramping; (6) facilitates to the guitarist a relaxed feeling while playing, by reducing finger cramping on the guitar neck; (7) facilitates a guitarist achieving desired balance of the guitar for the guitarist's specific style of playing; (8) provides means for adjusting guitar balance that are readily adjustable on the guitar; and (9) includes a structural reinforcement component for adding structural strength to the guitar neck. The foregoing desired characteristics are provided by the unique guitar neck apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved guitar neck apparatus is provided for a guitar which has a body portion, a neck portion attached to the body portion, and a string-tension-adjusting portion attached to the neck portion distal to the body portion. The guitar neck apparatus includes a plurality of convexly curved fret portions and a convexly curved first guitar neck portion underlying and supporting the convexly curved fret portions. The convexly curved first guitar neck portion extends between the guitar body portion and the string-tension-adjusting portion. The convexly curved first guitar neck portion includes a concavely shaped underside portion. A tongue portion extends radially from the concavely shaped underside portion. The tongue portion divides the concavely shaped underside portion into two concavely shaped groove portions suitable for receipt of one or more fingers of a guitar player. The concavely shaped groove portions are symmetrical about the tongue portion. The tongue portion has a bulbous cross section.

A reinforcement member is located in the apparatus. The reinforcement member is located in the tongue portion of the apparatus. The reinforcement member extends from the guitar body portion to the string-tension-adjusting portion.

An adjustable balancing assembly is provided that fits onto the guitar neck apparatus. The adjustable balancing assembly includes a lock nut assembly for locking the adjustable balancing assembly in a selected position along the guitar neck apparatus. The lock nut assembly includes a knurled nut, a threaded shaft attached to the spring-biased latch element, and a push pin urged by the threaded shaft toward the tongue portion.

The adjustable balancing assembly may include a resilient housing member that permits the adjustable balancing assembly to be installed on edge portions and of the convexly curved first guitar neck portion by a snap action.

The adjustable balancing assembly may include a resilient housing member that permits the adjustable balancing assembly to be installed on the tongue portion of the guitar neck apparatus by a snap action. The tongue portion has a bulbous cross-sectional shape, and the housing member includes an internal groove that has a complementary shape to the bulbous shape of the tongue portion.

A plurality of slide-assist assemblies may be installed in the housing member. The slide-assist assemblies facilitate sliding of the adjustable balancing assembly along the guitar neck apparatus. The slide-assist assemblies are installed in wells in the adjustable balancing assembly. The slide-assist assemblies includes a ball-retaining housing which includes an open end that has an internal diameter that is less than an outer diameter of a ball bearing, such that a ball bearing is retained in the ball-retaining housing. A ball bearing is retained at the open end of the ball-retaining housing. A round-side-containing bearing seat member is housed in the ball-retaining housing and is placed up against the ball bearing. A spring is housed in the ball-retaining housing behind the round-side-containing bearing seat member and urges the round-side-containing bearing seat member against the ball bearing such that the ball bearing extends partially out of the ball-retaining housing and is in rolling contact with the guitar neck apparatus, such that the adjustable balancing assembly is in sliding contact with the guitar neck apparatus.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved guitar neck apparatus which has all of the advantages of the prior art and none of the disadvantages.

It is another object of the present invention to provide a new and improved guitar neck apparatus which may be easily and efficiently manufactured and marketed.

It is a further object of the present invention to provide a new and improved guitar neck apparatus which is of durable and reliable construction.

An even further object of the present invention is to provide a new and improved guitar neck apparatus which is susceptible of a low cost of manufacture with regard to both materials and labor, and which accordingly is then susceptible of low prices of sale to the consuming public, thereby making such guitar neck apparatus available to the buying public.

Still yet a further object of the present invention is to provide a new and improved guitar neck apparatus which alleviates crowding of the guitarist's fingers on the topmost portion of the guitar neck.

Still another object of the present invention is to provide a new and improved guitar neck apparatus that relieves the cramping of the guitarist's fingers to be placed on the topmost, flat portion of a semi-circular guitar neck.

Yet another object of the present invention is to provide a new and improved guitar neck apparatus which has provisions for resting the thumb so as to lessen fatigue of the guitarist's hand.

Even another object of the present invention is to provide a new and improved guitar neck apparatus that has less string crowding and thus facilitates a more accurate and precise string fingering by the guitarist.

Still a further object of the present invention is to provide a new and improved guitar neck apparatus which imparts to the guitarist a greater feeling of style freedom by reducing finger cramping.

Yet another object of the present invention is to provide a new and improved guitar neck apparatus that facilitates to the guitarist a relaxed feeling while playing, by reducing finger cramping on the guitar neck.

Still another object of the present invention is to provide a new and improved guitar neck apparatus which facilitates a guitarist achieving desired balance of the guitar for the guitarist's specific style of playing.

Yet another object of the present invention is to provide a new and improved guitar neck apparatus which provides means for adjusting guitar balance that are readily adjustable on the guitar.

Still a further object of the present invention is to provide a new and improved guitar neck apparatus that includes a structural reinforcement component for adding structural strength to the guitar neck.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
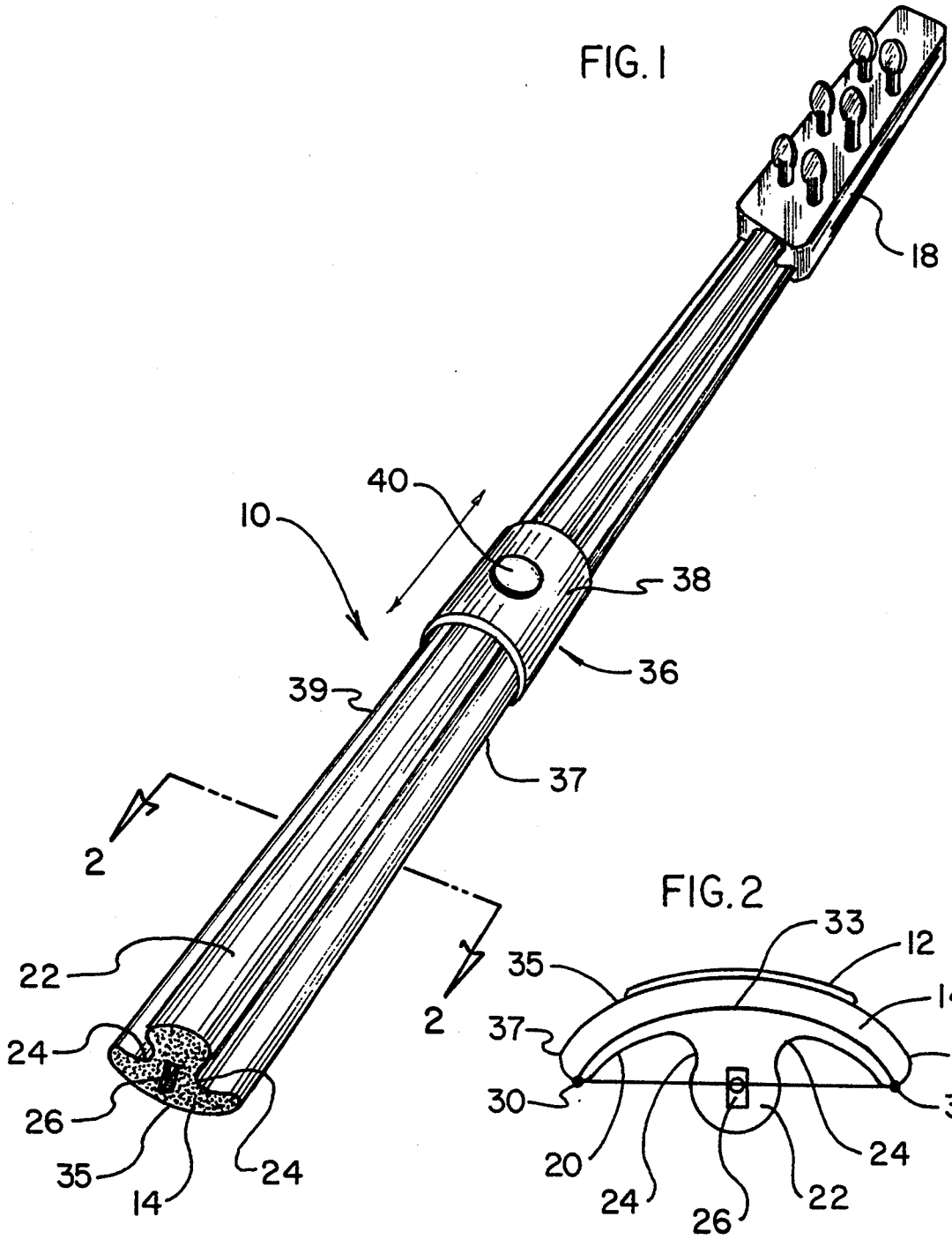
FIG. 1 is a perspective view, from below, showing a first preferred embodiment of the guitar neck apparatus of the invention; in this respect, the bottom of the guitar neck apparatus is seen to be above the top of the guitar neck apparatus; in addition, a first embodiment of a balancing assembly is installed on the embodiment shown in FIG. 1.

With reference to the drawings, a new and improved guitar neck apparatus embodying the principles and concepts of the present invention will be described.

Turning initially to FIGS. 1–4, there is shown a first exemplary embodiment of the guitar neck apparatus of the invention generally designated by reference numeral 10. The guitar neck apparatus 10 is provided for a guitar which has a body portion, a neck portion attached to the body portion, and a string-tension-adjusting portion attached to the neck portion distal to the body portion. In its preferred form, guitar neck apparatus 10 includes a plurality of convexly curved fret portions 12 and a convexly curved first guitar neck portion 14 underlying and supporting the convexly curved fret portions 12. The convexly curved first guitar neck portion 14 extends between the guitar body portion 16 and the string-tension-adjusting portion 18. The convexly curved first guitar neck portion 14 includes a concavely shaped underside portion 20. The convexly curved fret portions 12 and the convexly curved first guitar neck portion 14 may be portions of concentric circles that have a common radius. A tongue portion 22 extends radially to the common radius from the concavely shaped underside portion 20. The tongue portion 22 divides the concavely shaped underside portion 20 into two concavely shaped groove portions 24 suitable for receipt of one or more fingers of a guitar player. The concavely shaped groove portions 24 are symmetrical about the tongue portion 22.

Figure 2:
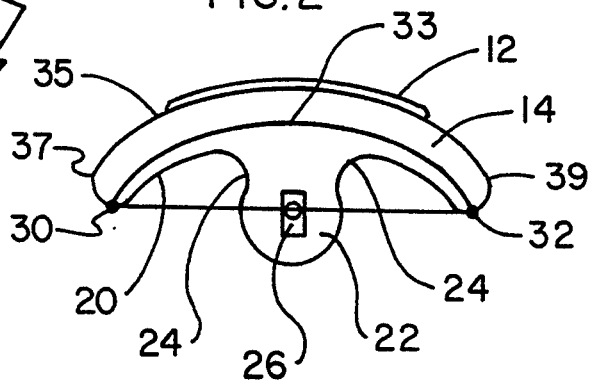
FIG. 2 is a cross-sectional elevational view of the guitar neck apparatus along line 2—2 of FIG. 1, wherein the view is turned upside down so that the top of the guitar neck apparatus appears above the bottom of the guitar neck apparatus.
Figure 3:
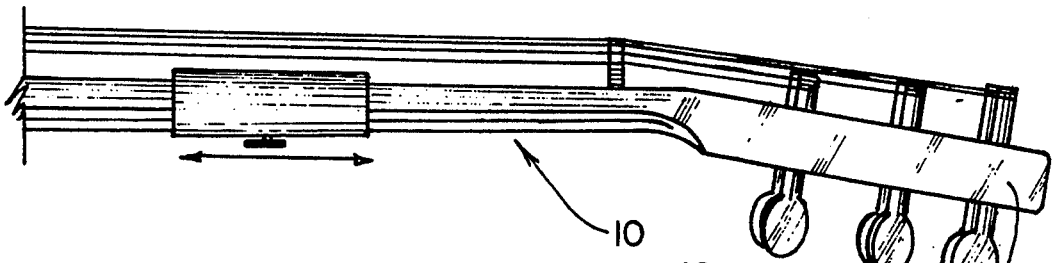
FIG. 3 is an enlarged side view of the distal end of the embodiment of the guitar neck apparatus of the invention shown in FIG. 1.
Figure 4:
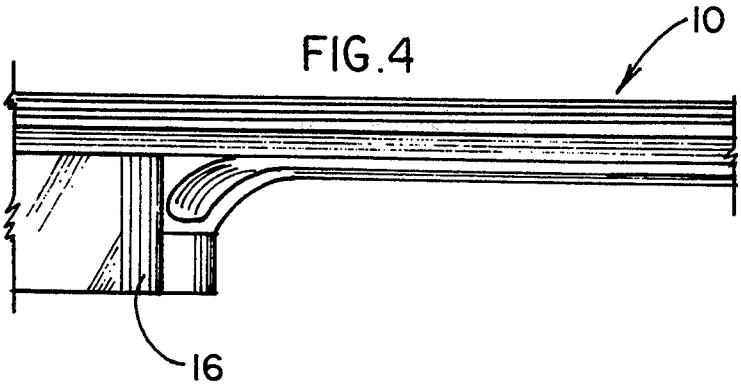
FIG. 4 is an enlarged side view of the proximal end of the embodiment of the guitar neck apparatus of the invention shown in FIG. 1.

By its very nature, a curved convexly curved first guitar neck portion 14 has a greater surface area than a conventional flat fret board. More specifically, as shown in FIG. 2, the conventional flat fret board may be likened to a straight line segment 28 that connects two end points 30 and 32. The convexly curved line 33 also connects the two points 30 and 32. By geometric definition, the line segment 28 is the shortest distance between the two points 30 and 32. In this respect, a surface area of a conventional fret board defined by lines extending from the two points 30 and 32 would be the smallest surface area. In sharp contrast, the convexly curved line 33 is longer than the straight line segment 28. Moreover, a surface area of the convexly curved first guitar neck portion 14 of the invention extending from the two points 30 and 32 is larger than the surface area of the corresponding flat fret board. Furthermore, the surface area of the top surface 35 of the convexly curved first guitar neck portion 14 is even greater than the surface area generated by convexly curved line 33.

The additional surface area provided by the convexly curved first guitar neck portion 14 of the invention provides less crowding for the strings, less crowding for the fingers of the guitarist, less cramping for the fingers of the guitarist, and a convenient place for the thumb of the guitarist to rest (within a groove 24). The convexly curved nature of the convexly curved first guitar neck portion 14 may also add to the vibrato quality of the string sounds.

A reinforcement member 26 is located in the apparatus 10. The reinforcement member 26 is located in the tongue portion 22 of the apparatus 10. The reinforcement member 26 extends from the guitar body portion 16 to the string-tension-adjusting portion 18. The reinforcement member 26 can be a lightweight piece of rigid metal.

Figure 7:
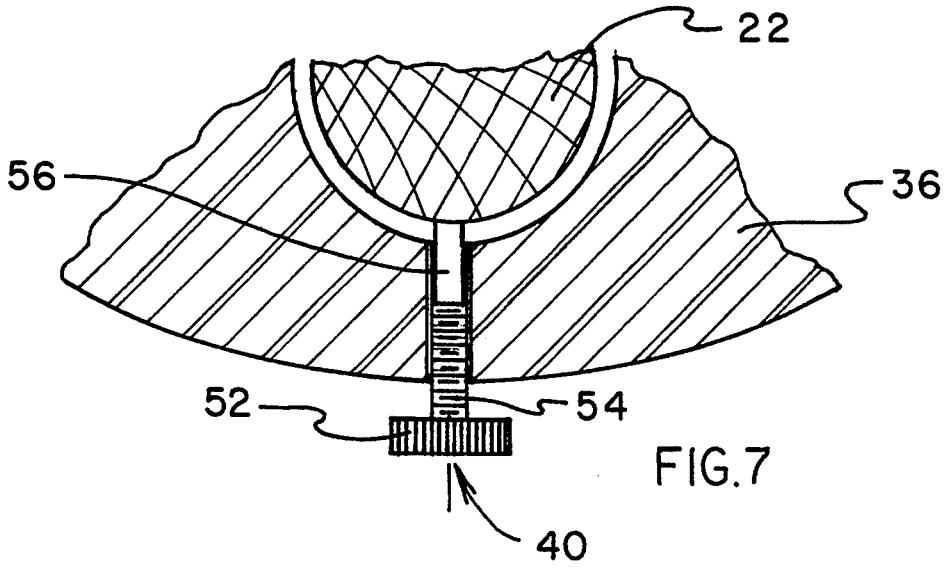
FIG. 7 is a partially enlarged cross-sectional view of the lock nut and shaft assembly shown in FIG. 5 taken along the line 7—7 of FIG. 5.
Figure 8:
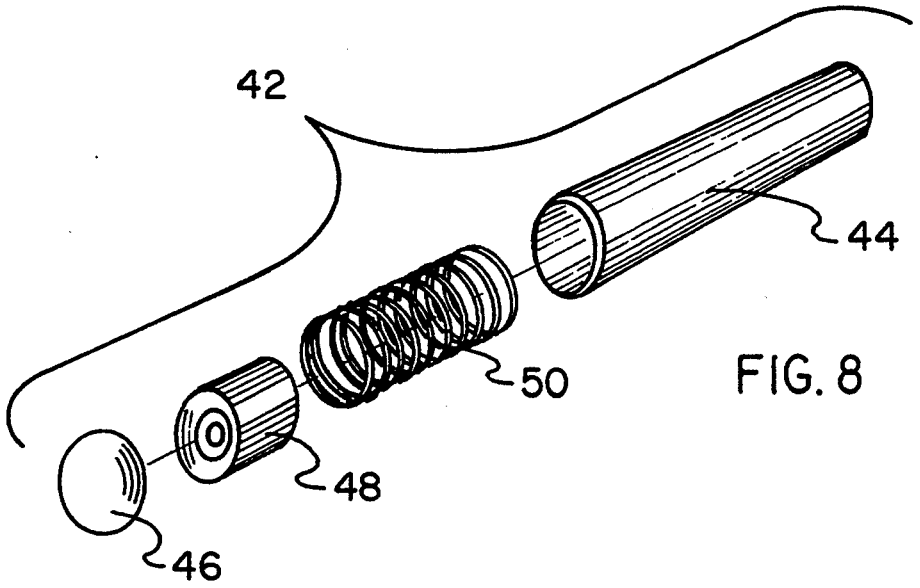
FIG. 8 is an enlarged, exploded, perspective view of the spring-biased tensioning assembly shown in FIG. 6.

An adjustable balancing assembly 36 is provided that fits onto the guitar neck apparatus 10. The adjustable balancing assembly 36 includes a lock nut assembly 40 for locking the adjustable balancing assembly 36 in a selected position along the guitar neck apparatus 10. As shown best in FIG. 7, the lock nut assembly 40 includes a knurled nut 52, a threaded shaft 54 attached to the spring-biased latch element 52, and a push pin 56 urged by the threaded shaft 54 toward the tongue portion 22. It is noted that the portion of the adjustable balancing assembly 36 adjacent to the threaded shaft 54 has a threaded portion complementary to the threaded portion 54. The adjustable balancing assembly 36 includes a resilient housing member 38 that permits the adjustable balancing assembly 36 to be installed on edge portions 37 and 39 of the convexly curved first guitar neck portion 14 by a snap action.

Figure 5:
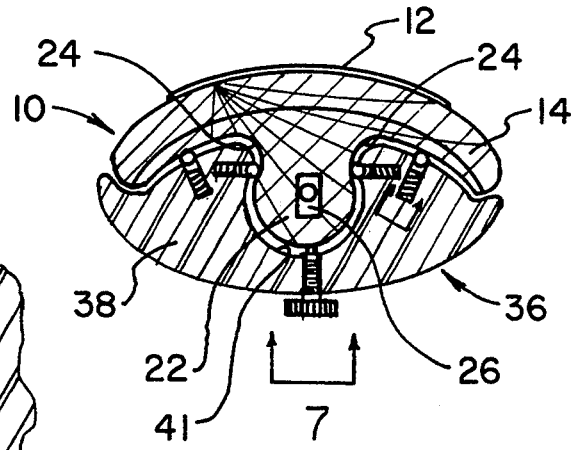
FIG. 5 is a cross-sectional view of a second embodiment of the balancing assembly of the invention installed on the embodiment of the guitar neck apparatus of the invention shown in FIG. 1.
Figure 6:
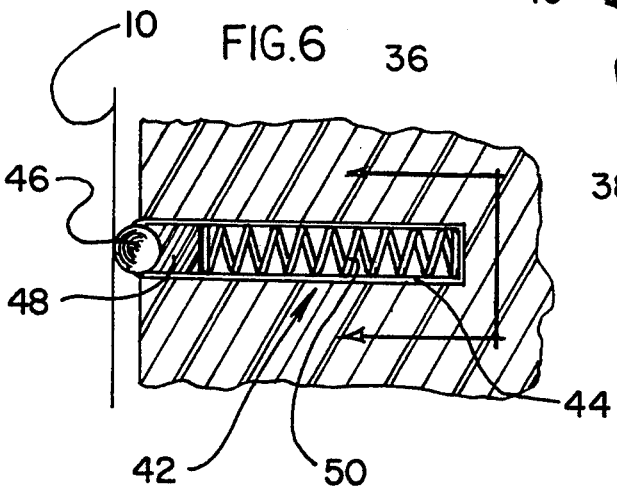
FIG. 6 is an enlarged cross-sectional view of a spring-biased tensioning assembly used to install the second embodiment of the balancing assembly of the invention on the guitar neck apparatus of the invention as shown in FIG. 5.
Figures 9, 10:
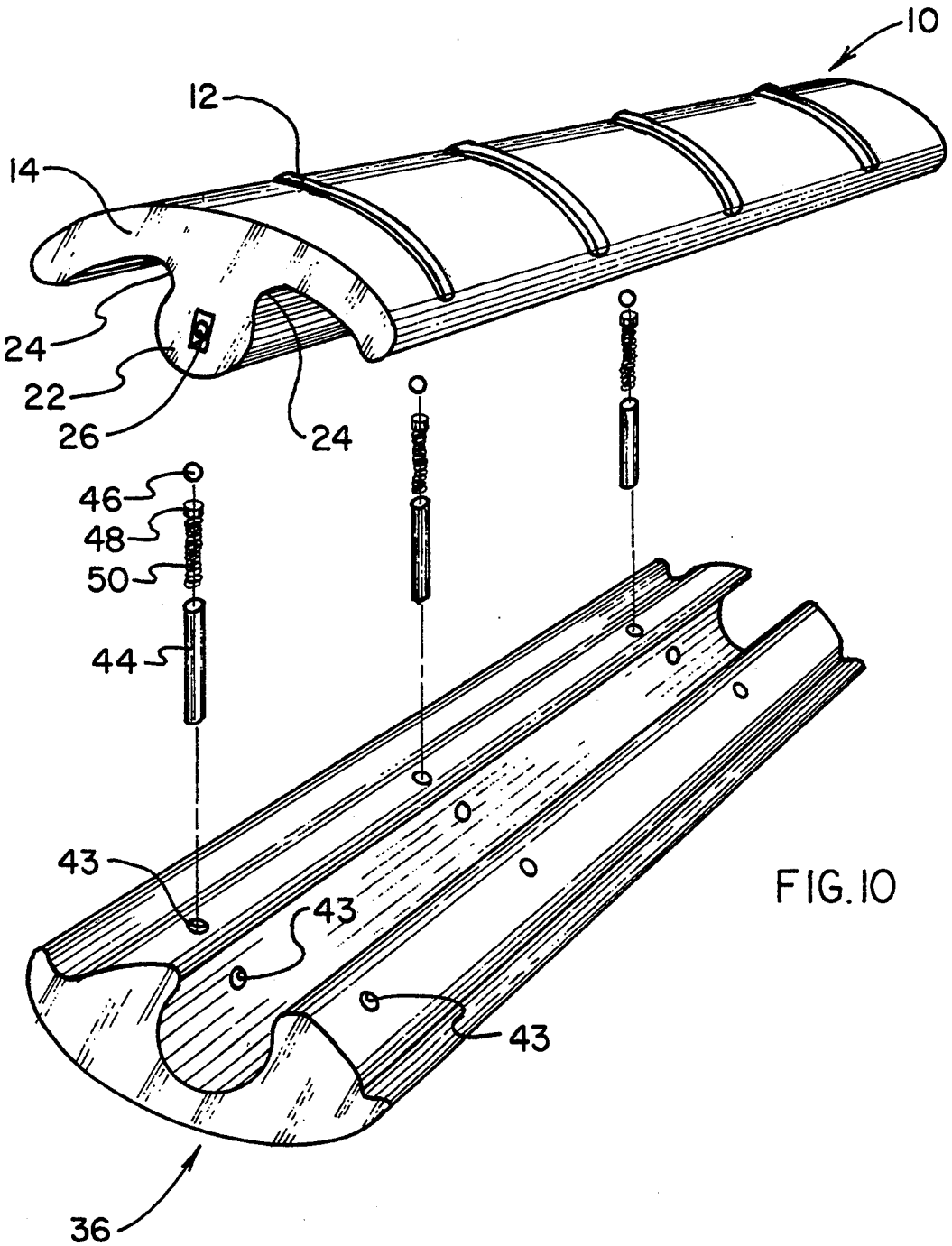
FIG. 9 is a partial perspective view of a portion of the guitar neck apparatus shown in FIG. 1 in a right side up position.
FIG. 10 is a partially exploded, perspective view of the second embodiment of the balancing assembly of the invention capable of being installed on the embodiment of the guitar neck apparatus of the invention shown in FIG. 9.

As shown in FIGS. 5 and 10, the adjustable balancing assembly 36 includes a resilient housing member 38 that permits the adjustable balancing assembly 36 to be installed on the tongue portion 22 of the guitar neck apparatus 10 by a snap action. The tongue portion 22 has a bulbous cross-sectional shape, and the housing member 38 includes an internal groove 41 that has a complementary shape to the bulbous shape of the tongue portion 22.

As shown in FIGS. 5, 6, 8, and 10, a plurality of slide-assist assemblies 42 are installed in the housing member 38. The slide-assist assemblies 42 facilitate sliding of the adjustable balancing assembly 36 along the guitar neck apparatus 10. The slide-assist assemblies 42 are installed in wells 43 in the adjustable balancing assembly 36. The slide-assist assemblies 42 includes a ball-retaining housing 44 which includes an open end that has an internal diameter that is less than an outer diameter of a ball bearing, such that a ball bearing is retained in the ball-retaining housing 44. A ball bearing 46 is retained at the open end of the ball-retaining housing 44. A round-side-containing bearing seat member 48 is housed in the ball-retaining housing 44 and is placed up against the ball bearing 46. A spring 50 is housed in the ball-retaining housing 44 behind the round-side-containing bearing seat member 48 and urges the round-side-containing bearing seat member 48 against the ball bearing 46 such that the ball bearing 46 extends partially out of the ball-retaining housing 44 and is in rolling contact with the guitar neck apparatus 10, such that the adjustable balancing assembly 36 is in sliding contact with the guitar neck apparatus 10.

The components of the guitar neck apparatus of the invention can be made from inexpensive and durable plastic and metal materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved guitar neck apparatus that is low in cost, relatively simple in design and operation, and which may advantageously be used to alleviate crowding of the guitarist's fingers on the topmost portion of the guitar neck. With the invention, a guitar neck apparatus is provided which relieves the cramping of the guitarist's fingers to be placed on the topmost, flat portion of a semi-circular guitar neck. With the invention, a guitar neck apparatus is provided which has provisions for resting the thumb so as to lessen fatigue of the guitarist's hand. With the invention, a guitar neck apparatus is provided which has less string crowding and thus facilitates a more accurate and precise string fingering by the guitarist. With the invention, a guitar neck apparatus is provided which imparts to the guitarist a greater feeling of style freedom by reducing finger cramping. With the invention, a guitar neck apparatus is provided which facilitates to the guitarist a relaxed feeling while playing, by reducing finger cramping on the guitar neck. With the invention, a guitar neck apparatus is provided which facilitates a guitarist achieving desired balance of the guitar for the guitarist's specific style of playing. With the invention, a guitar neck apparatus is provided which provides means for adjusting guitar balance that are readily adjustable on the guitar. With the invention, a guitar neck apparatus is provided which includes a structural reinforcement component for adding structural strength to the guitar neck.

With respect to the above description, it should be realized that the optimum dimensional relationships for the parts of the invention, to include variations in size, form function and manner of operation, assembly and use, are deemed readily apparent and obvious to those skilled in the art, and therefore, all relationship equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved guitar neck apparatus for a guitar having a body portion, a neck portion attached to the body portion, and a string-tension-adjusting portion attached to the neck portion distal to the body portion, said apparatus comprising:

a plurality of convexly curved fret portions, a convexly curved first guitar neck portion underlying and supporting said convexly curved fret portions, said convexly curved first guitar neck portion extending between the guitar body portion and the string-tension-adjusting portion, said convexly curved first guitar neck portion including a concavely shaped underside portion, and a tongue portion extending radially from said concavely shaped underside portion, said tongue portion dividing said concavely shaped underside portion into two concavely shaped groove portions suitable for receipt of one or more fingers of a guitar player, further including:

a reinforcement member located in said apparatus and wherein said reinforcement member is located in said tongue portion of said apparatus.

2. The apparatus described in claim 1 wherein said concavely shaped groove portions are symmetrical about said tongue portion.

3. The apparatus described in claim 1 wherein said tongue portion has a bulbous cross section.

4. The apparatus described in claim 1 wherein said reinforcement member extends from the guitar body portion to the string-tension-adjusting portion.

5. The apparatus described in claim 1, further including:

an adjustable balancing assembly that fits onto said apparatus.

6. The apparatus described in claim 5 wherein said adjustable balancing assembly includes a lock nut assembly for locking said adjustable balancing assembly in a selected position along said guitar neck apparatus.

7. The apparatus described in claim 6 wherein said lock nut assembly includes:

a knurled nut, a threaded shaft attached to said spring-biased latch element, and a push pin urged by said threaded shaft toward said tongue portion.

8. The apparatus described in claim 5 wherein said adjustable balancing assembly includes a resilient housing member that permits said adjustable balancing assembly to be installed on edge portions and of said convexly curved first guitar neck portion by a snap action.

9. The apparatus described in claim 5 wherein said adjustable balancing assembly includes a resilient housing member that permits said adjustable balancing assembly to be installed on said tongue portion of said guitar neck apparatus by a snap action.

10. The apparatus described in claim 8 wherein:

said tongue portion has a bulbous cross-sectional shape, and said housing member includes an internal groove that has a complementary shape to said bulbous shape of said tongue portion.

11. The apparatus described in claim 8, further including:

a plurality of slide-assist assemblies installed in said housing member, said slide-assist assemblies facilitating sliding of said adjustable balancing assembly along said guitar neck apparatus.

12. The apparatus described in claim 11 wherein said slide-assist assemblies are installed in wells in said adjustable balancing assembly.

13. The apparatus described in claim 12 wherein said slide-assist assemblies include:

a ball-retaining housing which includes an open end having an internal diameter that is less than an outer diameter of a ball bearing, such that a ball bearing is retained in said ball-retaining housing, a ball bearing retained at said open end of said ball-retaining housing, a round-side-containing bearing seat member, housed in said ball-retaining housing, and place up against said ball bearing, and a spring, housed in said ball-retaining housing behind said round-side-containing bearing seat member, for urging said round-side-containing bearing seat member against said ball bearing such that said ball bearing extends partially out of said ball-retaining housing and is in rolling contact with said guitar neck apparatus, such that said adjustable balancing assembly is in sliding contact with said guitar neck apparatus.

* * * * *